United States Patent [19]

Hopkins

[11] 4,129,212

[45] Dec. 12, 1978

[54] CARRIER AND STORAGE BINDER FOR FABRIC SAMPLES

[76] Inventor: Jack M. Hopkins, 4310 Lyon Dr., Columbus, Ohio 43220

[21] Appl. No.: 787,547

[22] Filed: Apr. 14, 1977

[51] Int. Cl.[2] ..... B65D 85/48

[52] U.S. Cl. ..... 206/450; 224/45 R; 402/77; 281/15 R

[58] Field of Search ..... 224/45 R, 45 N, 45 P; 206/450, 472; 281/15 R, 29, 16; 402/76, 77, 46, 64, 73, 74

[56] References Cited

U.S. PATENT DOCUMENTS

| | | | |
|---|---|---|---|
| 257,117 | 4/1882 | Wentworth | 281/15 R |
| 1,659,395 | 2/1928 | Douglas | 402/77 |
| 2,120,818 | 6/1938 | Steinthal | 281/15 R |
| 2,258,418 | 10/1941 | Macey | 281/29 |
| 3,087,498 | 4/1963 | Vogel | 402/77 |
| 3,972,632 | 8/1976 | Carter | 281/29 |

FOREIGN PATENT DOCUMENTS

| | | | |
|---|---|---|---|
| 315271 | 2/1934 | Italy | 402/76 |

*Primary Examiner*—Trygve M. Blix
*Assistant Examiner*—Kenneth W. Noland
*Attorney, Agent, or Firm*—Mahoney & Stebens

[57] ABSTRACT

A carrier and storage binder for fabric samples is provided having a structure advantageously designed for convenient display of fabric samples as well as portability and to also be structurally self supporting for storage in an upright position on shelves or other supporting surfaces. This carrier and storage binder is fabricated from a one piece sheet of plastic material having rear and front covers or panels that are integrally hinged through a spine member to provide the necessary thickness for a stack of fabric samples. The back cover is provided with a header support element which is also integrally hinged for relative swinging movement along an axis transverse to the hinge axis of the front and rear cover elements. Structural rigidity of the carrier in a closed configuration with the cover elements overlying and superimposed on the stack of fabric samples is achieved through inclusion of suitable cooperative fastening elements that are attached to opposed surface portions of the header and inner surface of the cover. Preferably, a Velcro tape or similar fabric-type fastening device is utilized with one of the two cooperating elements being adhesively bonded to opposed surfaces at the edges most remote to the interconnecting spine and cover hinge element.

29 Claims, 5 Drawing Figures

CARRIER AND STORAGE BINDER FOR FABRIC SAMPLES

BACKGROUND OF INVENTION

Various types and configurations of carriers have been heretofore devised for utilization in the carrying and display of samples of fabric, rug, wallpaper or other materials that are of flat, sheet-form. The known carrier structures, which have been heretofore employed in sales field for fabrics and rugs, generally include a structurally rigid back plate provided with a header element that may be hinged to the back plate for relative swinging movement. The header element is normally of an elongated channel configuration adapted for receiving marginal edge portions of the fabric samples which are secured in the header by suitable fastening means. Conventionally, a number of bolt or pin-type fasteners are provided to extend between opposed flanges of the header channel and through the marginal edge portions of the fabric samples.

Examples of previously utilized structures are disclosed in U.S. Pat. No. 3,237,825, issued to C. H. Marbut on Mar. 1, 1966 and U.S. Pat. No. 3,631,975, issued to Martin H. Leibowitz on Jan. 4, 1972. The structures disclosed in those patents exemplify the customary configuration and structural combinations employed in such carriers. While these carriers are capable of readily facilitating portability of the fabric samples through the provision of carrying handles and the advantageous display of the fabrics through the pivoted or hinged arrangement of the header to the back or cover plate, these carriers are of a construction having a substantial disadvantage in convenience of utilization in that they are not particularly adapted for storage on shelves or other supporting surfaces.

Generally, these samples carriers are of a type that must be laid flat on horizontal surfaces for storage and consequently must be stacked one on top of the other in the interest of conserving storage space or may be hung by their carrying handle. This is true for either a salesman who must transport a number of such carriers in providing a selection to a customer or a person who primarily operates in a sales room or designer's situation where customers or the designer examine the fabric samples in a fixed location such as an office or design room, or a sales room.

SUMMARY OF THE INVENTION

It is a primary objective of this invention to provide a novel carrier and storage binder for such fabric samples that will materially enhance the assessibility and selection of specific samples for consideration and examination. This objective is achieved by providing a structural arrangement that results in a device which may be selectively configured to provide the necessary structural rigidity for upright positioning on a storage shelf. A sample carrier and storage binder which may be vertically positioned for storage on a shelf can thus be more readily selected from a considerable number of such binders forming a reference library through the application of suitable indicia or identifying information on visible portions of the binder. Specifically, the structure in a closed configuration resembles a notebook binder having front and back covers interconnected by a rigid spine that is relatively hinged to both the front and back covers. Additionally, the front and back covers are provided with means for rigidly interconnecting the relatively free ends remote to the interconnecting spine and thus produce a structurally rigid arrangement that will be self supporting when placed in a vertical position on a shelf.

The carrier and storage binder of this invention, in an exemplary embodiment, includes a structure that may be advantageously formed from a one-piece sheet of plastic material that is of a type particularly adapted to the formation of integrally formed hinge elements between the several structural components. This unitary structure comprises front and back covers of plate or sheet form that are also structurally rigid so as to be capable of supporting the weight of the sample fabrics inserted in the carrier. The cover and back plates are interconnected by a rigid spine through the integral hinge elements and a fabric engaging header is also integrally hinged to the back cover or plate. A Velcro tape fastening device in the form of two cooperating circles is adhesively bonded to opposed surfaces of the inner surface of the cover plate and a surface of the header at the side most remote to the spine for selectively securing the cover and back plates in relatively rigid relationship. This securing of the cover and back plates at the end remote from the spine provides the necessary structural rigidity for the device to adequately support and accommodate the vertically suspended weight of the fabric samples contained within the carrier.

These and other objects and advantages of this invention will be readily apparent from the following detailed description of an illustrative embodiment thereof and the accompanying drawings.

DESCRIPTION OF THE DRAWING FIGURES

DETAILED DESCRIPTION OF THE ILLUSTRATED EMBODIMENT

Figure 1:
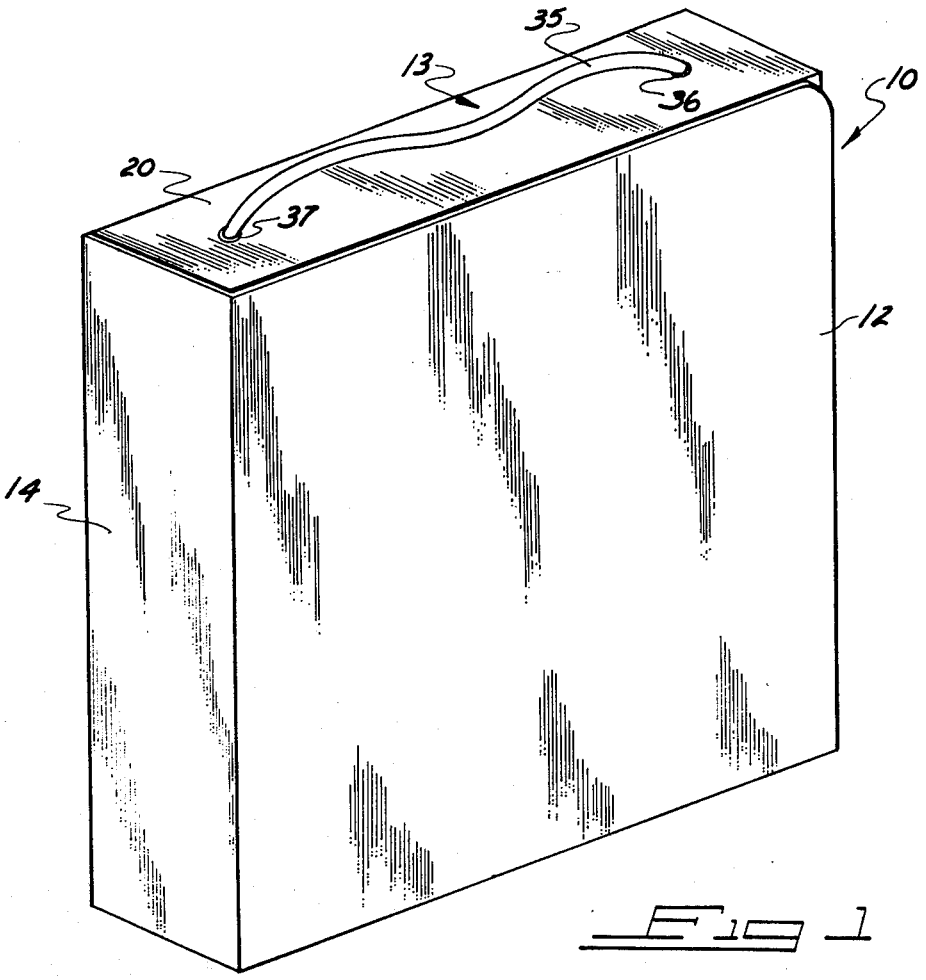
FIG. 1 is a perspective view of the carrier and storage binder embodying this invention and configured for vertical positioning and support on a horizontal shelf.
Figure 2:
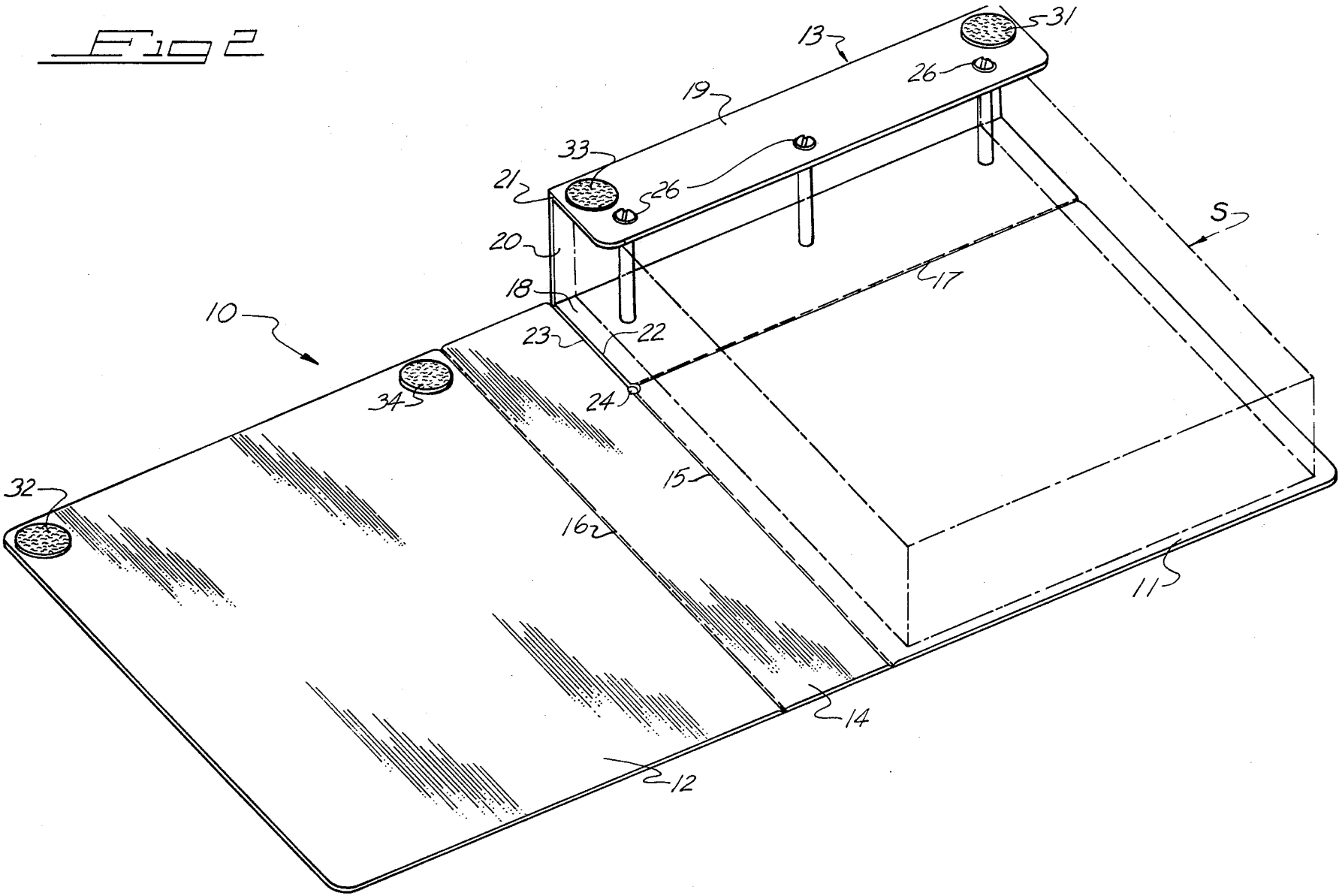
FIG. 2 is a perspective view of the carrier with the cover plate pivoted on an open position for display of the fabrics.

Having reference to the drawings, a carrier and storage binder embodying this invention, and designated generally by the numeral 10, is shown in each of the two configurations in which the device may be placed. In FIG. 1, the carrier is shown in closed or assembled relationship for vertical positioning on a supporting shelf. In FIG. 2, the carrier is shown opened for display and examination of the fabric samples, designated by the letter S and secured in the header.

Referring specifically to FIG. 2, the structural components and arrangement thereof can be best seen as including a rear panel or back plate 11, front panel or cover plate 12 and a fabric header 13. These components are preferably fabricated from a unitary, sheet-form piece of suitable plastic material which is specifically adapted to the formation of the well known integral hinges. Such materials are well known and designation of a specific material is not deemed necessary for a complete disclosure providing a clear understanding of this invention.

While plastic materials are preferred, it will be understood that other materials such as laminated sheets of pressboard may also perform satisfactorily. Also, it will be apparent that mechanical hinge structures may be substituted for the integral hinge elements. For illustration of dimensional characteristics, the illustrated unit is designed for carrying and storage of fabric samples which are of the order of 10 inches square stacked to a height of approximately 3 inches and which stack may be inserted within and secured to the header 13. For obtaining the necessary support and structural rigidity, the sheet of plastic material may be of the order of ⅛ inch thick.

The back plate 11 will be noted to be of a relatively shorter length than the cover plate but the height of the header 13 is complementary to result in a composite back cover section that is of the same height as the cover plate. Interconnecting the back plate and cover plate 12 is a spine 14, which is interconnected at spaced parallel edges to respective adjacent edge portions of the back and cover plate. This interconnection as previously indicated is preferably of the integral hinge type to result in a unitary structure. These hinges are indicated at 15 and 16 and, in accordance with the usual practice for the fabrication of such hinge elements, the material forming this structure may be of a different thickness at the hinge line or formed from a plastic material having a different durometer such as to readily facilitate the repeated bending operations that will be experienced through normal operation and utilization of the device.

Similarly the fabric header 13, which comprises a U-shaped channel is secured at one terminal edge of one flange to the upper end or edge of the back plate 11. This hinge line is designated 17 in FIG. 2 and is seen to extend in transverse relationship to the hinges 15 and 16 at the spine interconnecting the cover and back plates. This fabric header 13 is of U-shaped channel form and includes two flanges 18 and 19 interconnected by a web 20. The flange 18 and web 20 are preferably molded without a hinged interconnection and thus results in a substantially rigid angle element. The other flange 19, however, is preferably interconnected with the web 20 by an integrally formed hinge element 21. This hinging of the flange 19 to the web 20 facilitates the insertion and removal of the fabric samples S, as this flange 19 may then be readily swung upwardly to permit the vertical lifting of the fabric samples from the fastening means that are also incorporated in the structure.

It will be further noted that the channel-form header 13 is open at each end with the flange 18 having an end edge 22 which is separated or spaced from an adjacent opposed edge 23 of the spine 14. These adjacent but spaced edges 22 and 23 thus define an elongated slot which opens at the uppermost end of the device and terminates at the hinge line 17 in a slightly enlarged aperture 24. This aperture 24 is formed at the juncture of the hinge line 17 with the spine hinge 15 and is of a size to prevent interference with the relative hinged movement of the spine about its hinge axis 15 or the header 13 about its respective hinge axis 17.

Securing of the stacked fabric samples S, in the header 13 may be conveniently achieved through use of screw post or other bolt type fasteners commonly utilized in fabric sample carriers. The illustrated fasteners 26 include two sections which may be threaded to interengage and form smooth-surfaced post elements that extend through the fabric samples. It will be understood that other types of fasteners or securing devices may be utilized and will also perform satisfactorily. Three such fastening devices 26 are shown assembled with the header 13 of the illustrated device. It will be apparent that the number of such fastener devices may be increased or decreased in accordance with the dimensions of the particular carrier as well as the weight that is to be supported by the header and the size of the samples in the stack.

In accordance with this invention, the structure is designed with cover and back plates 11 and 12 hingedly interconnected by an intermediate spine 14 to permit folding to the open configuration shown in FIG. 2 or to the closed configuration shown in FIG. 1. This is accomplished merely by swinging the cover 12 and associated spine 14 about the axis of their respective hinge elements 15 and 16 to place the spine in perpendicular relationship to the back plate with the cover plate 12 then overlying and in superposed relationship to the back plate as well as the enclosed fabric samples S.

In this closed configuration, as can be best seen in FIG. 1, the upper marginal edge portion of the cover plate 12 will then overlie the outer flange 19 of the header 13. To obtain the desired structural rigidity for positioning of the carrier and storage binder in a vertically oriented self-supporting relationship on a shelf, the cover and header 13 are provided with suitable cooperative fastening means to retain the cover 12 in fixed relationship to the header 13 and back plate 11. In the illustrated embodiment, this fastening means may advantageously be of the cooperating interconnecting hook and loop devices such as that commonly known as Velcro tape. As best seen in FIG. 2, the fastening means includes a circular element 31 of a hook-type fabric material and a mating circular element 32 of a loop-type fabric material. These two circular elements are adhesively bonded to the respective outwardly facing surface of the flange 19 and the inner surface of the cover plate 12. As indicated in FIG. 2, the location of these two elements 31 and 32 is such that the cover plate will be secured to the header 13 at the edge which is remote to the spine 14. With this positioning of the fastening element components 31 and 32, folding of the front and back covers or plates 11 and 12 to the configuration shown in FIG. 1, will result in the cover plate 12 providing the necessary vertical support for the outer side of the header 13 at the point most remote to the spine. This support in most cases, is sufficient to provide the necessary structural rigidity of the carrier as to enable the carrier to maintain itself in the desired vertical position while suspending the fabric samples S, from the header 13. The width or thickness of the carrier necessary to accommodate an adequate number of fabric samples is normally of such an extent that a sufficiently wide base is provided to obtain the desired stability of the carrier for vertical self-support without resort to additional or auxiliary lateral supporting mechanisms or means.

While only one fastening device which includes the elements 31 and 32 is generally sufficient to maintain the carrier in the illustrated closed configuration, it will be understood that additional fastening devices may be provided to further enhance the structural rigidity of the carrier. For this purpose, similar type fastening devices including cooperating circular elements 33 and 34 may be applied to at least the inner end and opposed surface of the cover 12 of the flange 19 as indicated, as well as perhaps at an intermediate point. The number and necessity of such additional fastening units is again dependent on the dimension of the specific carrier as well as the weight of the sample materials that are to be supported by the header.

With reference to FIG. 1, it will also be seen that the carrier is advantageously provided with a suitable carrying handle. In this illustrated embodiment, the handle comprises a length of flexible cord 35 which extends longitudinally of the header 13. The opposite terminal end portions of the cord 35 are inserted through respective apertures 36 and 37 which are formed in the web 20 in longitudinally spaced relationship. The inner ends of the cords may be provided with knots for securing the cord in retained relationship with the header and thus enable a person to pick up the carrier for transport to a suitable location. It will be understood that other types of handles or straps may also be used satisfactorily.

Figure 3:
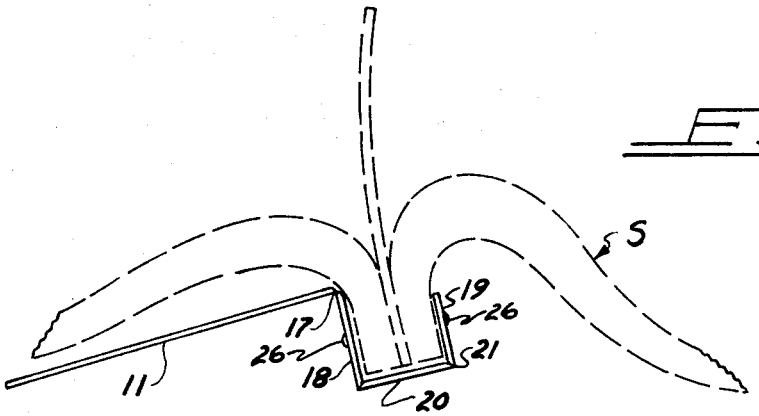
FIG. 3 is an end elevational view of the carrier with the header pivoted to a position for more conveniently displaying the fabric samples.

Utilization of the carrier in displaying the fabric samples S is further illustrated in FIG. 3. This figure shows the carrier in side elevation when opened and having the header 13 pivoted to a position relative to the back plate 11 where the fabric samples may be easily viewed.

Figure 4:
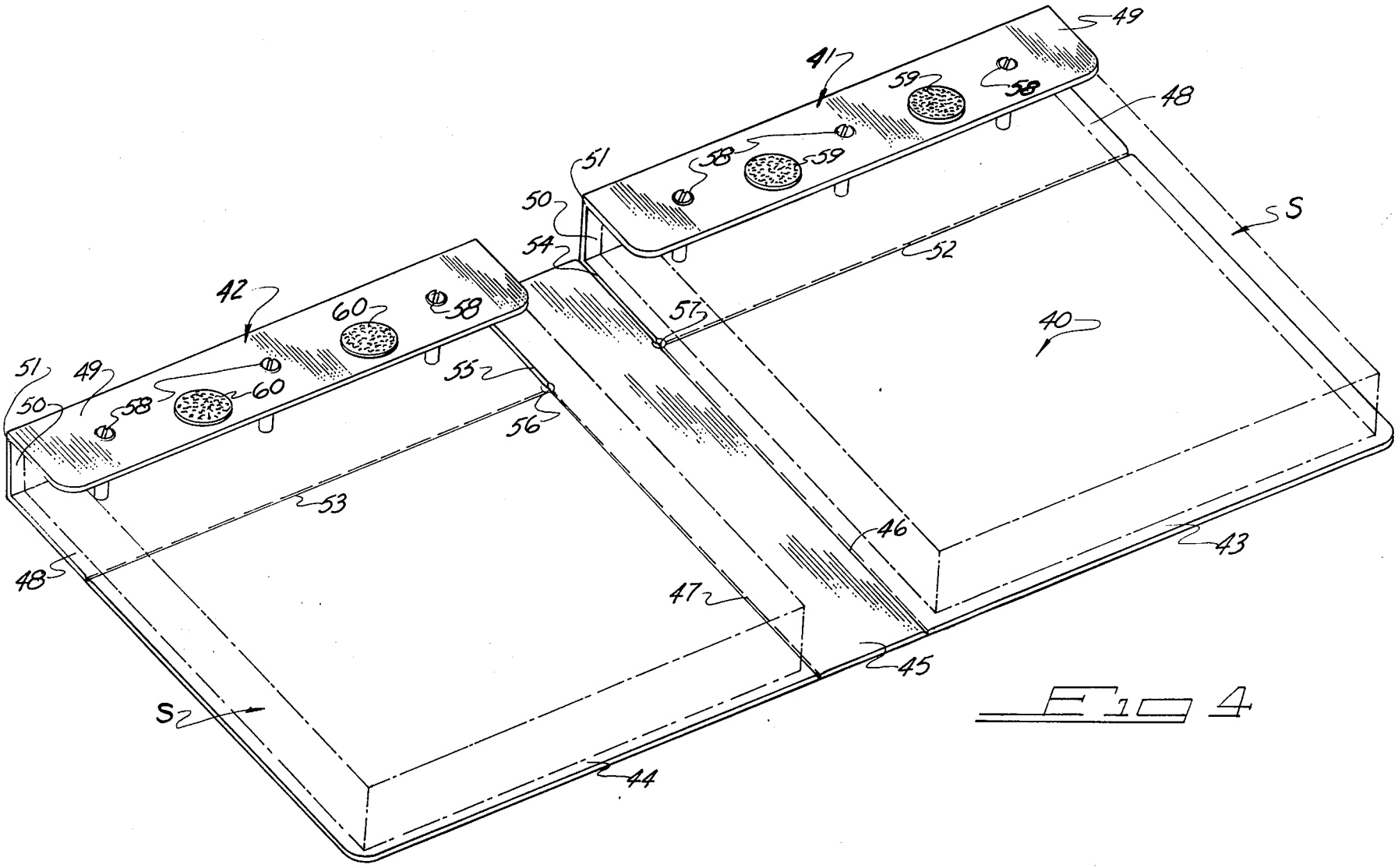
FIG. 4 is a perspective view of a modified carrier with the carrier shown opened to a display position.
Figure 5:
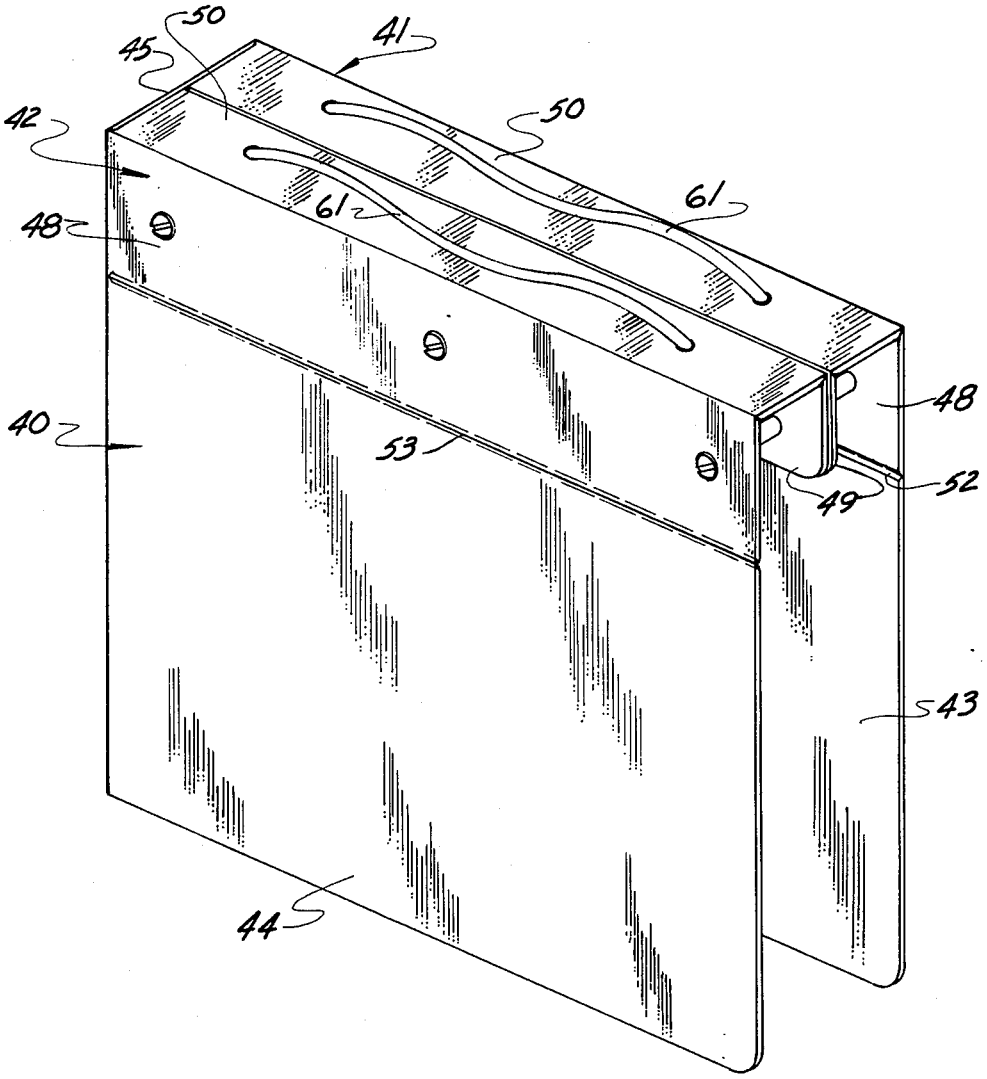
FIG. 5 is a perspective view of the modified carrier of FIG. 4 in a closed configuration.

The novel carrier annd storage binder for fabric samples heretofore described has been specifically adapted to the insertion of the fabric samples to a header formed with only the back plate. A modified form of carrier and storage binder designated generally by the numeral 40 is illustrated in FIGS. 4 and 5. This modified carrier structure differs from the previously described embodiment of the invention only in respect that the fabric samples are secured in two sections to respective headers 41 and 42 formed with the respective rear panel or back plate 43 and cover plate 44. It will be noted that the header 42 and associated cover plate 44 in this embodiment combine in height and are of a width to be coextensive with the combined back plate 43 and header 41 and are thus equivalent to the cover plate or front panel of the first described embodiment. This modified carrier may also advantageously be formed from a plastic material with the back and cover plate 43 annd 44 interconnected by an elongated spine 45. The spine 45, in this instance, will be of a width such that it will be substantially equal to the combined depth of both headers 41 and 42. Again it will be noted that the spine 45 is preferably interconnected with the back and cover plates by means of an integrally formed hinge 46 and 47 at each respective side.

Each of the headers 41 and 42 is of channel form and include spaced flanges 48 and 49 and an interconnecting web 50. As in the first embodiment, it is preferred to construct the header channel in such a manner that the flange 49 is connected to the web 50 by an integrally formed hinge element 51 whereas the flange 48 is preferably connected to the web 50 without a hinge structure. Each of the headers 41 and 42 is connected to the respective back plate 43 and cover plate 44 at the upper end thereof. As previously shown, the two headers also extend in transverse relationship to the spine 45 and the interconnection of the flange 48 of each header to the respective back or cover plate is advantageously achieved through respective integrally formed hinge elements 52 and 53. Preferably the spine 45 projects a distance upwardly to terminate in coextensive relationship to the respective webs 50 of each of the headers 41 and 42. The headers 41 and 42, however, are not connected to the spine and, as can be seen in FIG. 4, the adjacent edges are defined by respective slots 54 and 55 which terminate in the enlarged apertures 56 and 57. These apertures again facilitate the relative hinged movement of the header with respect to either the back or cover plate.

Securing of the respective stacks of fabric samples S in the two headers 41 and 42 is achieved through utilization of screw post fasteners as previously described or other suitable fastening devices. The illustrated fasteners 58 include slotted heads at each end and elongated posts that project through apertures formed in the individual sheets of fabric samples.

The modified form of carrier is also designed to be hinged to a closed configuration such as that illustrated in FIG. 5. In this closed configuration, the respective headers 41 and 42 are disposed in adjacent relationship with respect to the flanges 49. For securing the two sections in this closed configuration, each of the exterior surfaces of the flanges 49 of the header are provided with cooperative fastening elements indicated at 59 and 60. In this illustrative embodiment, the two elements 59 and 60 are also advantageously formed of the cooperative interconnecting hook and loop devices such as the generally known as Velcro tape. A pair of such fastening elements 59 and 60 are shown secured to the opposed surfaces of the flanges 49 and these elements are disposed in areas between the bolt type fastening elements 58. With the carrier thus closed as shown in FIG. 5 these fastening elements 59 and 60 will secure the header flanges 49 in relatively fixed relationship. With the flanges 49 thus secured the headers 41 and 42 will also be maintained in fixed relationship and rigidly supported by the respective back and cover plates 43 and 44. The relatively rigid interconnection of the flanges 49 will effectively eliminate any undesirable lateral swinging of the headers with respect to the back and cover plates. A cord type handle 61 may also be secured to the web 50 of each header 41 and 42 to facilitate carrying. It will be understood that either handles or straps may be satisfactorily substituted for the cord.

It will be readily apparent from the foregoing detailed description of an illustrated embodiments thereof, that a particular novel and useful carrier and storage binder has been provided for the storage and display of fabric samples. In accordance with this invention, the carrier and storage binder includes cover and back plates that are hingedly interconnected by an intermediate spine and provided with appropriate fastening means for securely interconnecting the elements into a structurally rigid and self supporting structure.

Having thus described the invention, what is claimed is:

1. A carrier and storage binder for samples of sheet-form material disposed in stacked relationship comprising a structurally rigid rear panel having a bottom edge, a top edge and a side edge extending therebetween, a header secured by hinge means to said rear panel at the top edge thereof in upwardly projecting relationship, for relative pivoting of said header on said rear panel said header adapted to receive fabric sample sheets in retained relationship with the samples extending therefrom in superposed relationship to said rear panel, a structurally rigid front panel having a side edge with said front panel hingedly interconnected with said rear panel at said side edges thereof for selective swinging movement relative to that edge between a closed position disposed in superposed relationship to said rear panel and said header with the sample sheets interposed therebetween and an open position wherein said front panel is disposed to permit visual inspection of the samples, said front panel having a vertical extent substantially equal to the combined vertical extent of said rear panel and said header, and securing means adapted to selectively interconnect with said header and said front panel for maintaining said header in rigidly fixed relationship to said rear panel and maintaining said front panel in closed relationship to said rear panel.

2. A carrier according to claim 1 wherein said securing means includes first and second mechanically interengageable elements with one of said elements mounted on said header and the other mounted on said front panel.

3. A carrier according to claim 2 wherein said securing means elements are mounted on said header and front panel in relatively remote relationship to the side at which said front panel is interconnected with said rear panel.

4. A carrier according to claim 2 wherein said securing means elements includes a plurality of sets of first and second mechanically interengageable elements disposed in relatively spaced relationship across said header and a top edge of said front panel.

5. A carrier according to claim 2 wherein said first and second mechanically interengageable elements are hook and loop elements, respectively, of a fabric type fastening means.

6. A carrier according to claim 1 wherein said header is of elongated channel-form having spaced flanges interconnected along an edge of each by a web, a first one of said flanges disposed in coplanar relationship to said rear panel with a second one of said flanges spaced a distance from the first flange to receive a marginal edge portion of sheet-form material samples disposed in overlying relationship to said rear panel.

7. A carrier according to claim 6 wherein said rear and front panels are interconnected through a spine having a width substantially equal to the spacing of said header flanges, said spine extending along and connected with a respective side edge of said rear and front panels.

8. A carrier according to claim 7, wherein said spine is connected to at least one of said rear and front panels by hinge means.

9. A carrier according to claim 8 wherein said hinge means includes a hinge element integrally formed with said spine and rear panel.

10. A carrier according to claim 7 wherein said spine is connected to said rear and front panels by respective hinge means.

11. A carrier according to claim 10 wherein each of said hinge means includes a hinge element integrally formed with said spine and said rear and front panels.

12. A carrier according to claim 6 wherein said first header flange disposed in coplanar relationship to said rear panel is connected thereto along an edge of the flange opposite that edge connected to said web.

13. A carrier according to claim 12 wherein said hinge means includes a hinge element integrally formed with said header flange and rear panel.

14. A carrier according to claim 6 wherein said second header flange is connected to the header web by header hinge means.

15. A carrier according to claim 14 wherein said header hinge means includes a hinge element integrally formed with said header web and second flange.

16. A carrier according to claim 6 wherein said securing means includes cooperatively interengageable elements which are mounted on respective opposed surface portions of said second header flange and said front panel.

17. A carrier according to claim 1 wherein said front and rear panels are interconnected through a spine which is of a length substantially equal to the combined vertical extent of said header and rear panel, said spine being connected to only said rear and front panels.

18. A carrier according to claim 1 wherein said front panel includes a cover plate formed with a top edge and a header secured by hinge means to said cover plate at said top edge thereof in upwardly projecting relationship, for relative pivoting of said header on said cover plate said header adapted to receive sample sheets in retained relationship with the samples extending therefrom in superposed relationship to said cover plate and interposed between said cover plate and rear panel when said panels are swung to the closed position, said securing means adapted to selectively interconnect with each of said headers for maintaining said header in rigidly fixed relationship to respective ones of said cover plate and rear panel.

19. A carrier according to claim 18 wherein each of said headers is of elongated channel form having spaced flanges and a web interconnected along an edge of each flange, a first one of said flanges of each header disposed in coplanar relationship to a respective one of said rear panel and cover plate.

20. A carrier according to claim 19 wherein said rear panel and cover plate are interconnected through a spine having a width substantially equal to the combined spacing of said two sets of header flanges.

21. A carrier according to claim 20 wherein said spine is interconnected with said rear panel and cover plate by hinge means.

22. A carrier according to claim 21 wherein said hinge means includes a respective hinge element integrally formed with said spine and each of said cover plate and rear panel.

23. A carrier according to claim 19 wherein said header hinge means includes a hinge element integrally formed with each header flange and respective cover plate and rear panel.

24. A carrier according to claim 19 wherein said securing means includes first and second mechanically interengageable elements which are mounted on respective opposite header flanges.

25. A carrier according to claim 24 wherein said securing means includes a plurality of sets of said first and second mechanically interengageable elements disposed in transversely spaced relationship across said headers.

26. A carrier and storage binder for samples of sheet-form material disposed in stacked relationship comprising a structurally rigid rear panel having a bottom edge, a top edge and side edges extending therebetween, a header secured by hinge means to said rear panel at the top edge thereof in upwardly projecting relationship, said header adapted to receive fabric sample sheets in retained relationship to said rear panel, a structurally rigid front panel having a bottom edge, a top edge and side edges extending therebetween with said front panel hingedly interconnected with said rear panel at one side edge thereof for selective swinging movement relative to that edge between a closed position disposed in superposed relationship to said rear panel with the sample sheets interposed therebetween and an open position wherein said front panel is disposed to permit visual inspection of the samples, and securing means adapted to selectively interconnect with said header and said front panel for securing said front panel, header and rear panel in rigidly fixed relationship when said front panel is swung to a closed position relative to said rear panel, said securing means including fastening means having first and second mechanically interengageable fabric-type hook and loop elements with one element mounted on said header and the other mounted on said front panel.

27. A carrier and storage binder for samples of sheet-form material disposed in stacked relationship comprising a structurally rigid rear panel having a bottom edge, a top edge and side edges extending therebetween, a header secured to said rear panel at the top edge thereof in outwardly projecting relationship, said header adapted to receive fabric sample sheets in retained relationship with the samples extending therefrom in superposed relationship to said rear panel, said header being of elongated channel-form having spaced flanges interconnected along an edge of each by a web, a first one of said flanges disposed in coplanar relationship to said rear panel with a second one of said flanges spaced a distance from the first flange to receive a marginal edge portion of sheet-form material samples disposed in overlying relationship to said rear panel, a structurally rigid front panel having a bottom edge, a top edge and side edges extending therebetween with said front panel hingedly interconnected with said rear panel at one side edge thereof for selective swinging movement relative to that edge between a closed position disposed in superposed relationship to said rear panel with the sample sheets interposed therebetween and an open position wherein said front panel is disposed to permit visual inspection of the samples, said front panel having a vertical extent substantially equal to the combined vertical extent of said rear panel and header whereby said front panel, when swung to a closed position overlying said rear panel, will overlie the second of said header flanges, and securing means adapted to selectively interconnect with said header for maintaining said header in rigidly fixed relationship to said rear panel, said securing means includes fastening means having cooperatively interengageable elements which are mounted on respective opposed surface portions of said second header flange and said front panel.

28. A carrier and storage binder for samples of sheet-form material disposed in stacked relationship comprising a structurally rigid rear panel having a bottom edge, a top edge and side edges extending therebetween, a header secured to said rear panel at the top edge thereof in outwardly projecting relationship, said header adapted to receive fabric sample sheets in retained relationship with the samples extending therefrom in superposed relationship to said rear panel, said header being of elongated channel-form having spaced flanges interconnected along an edge of each by a web, a first one of said flanges disposed in coplanar relationship to said rear panel with a second one of said flanges spaced a distance from the first flange to receive a marginal edge portion of sheet-form material samples disposed in overlying relationship to said rear panel, said first header flange being connected along an edge thereof opposite that edge connected to said web to said rear panel at the top edge thereof by hinge means permitting relative swinging movement of said header about the top edge of said rear panel.

a structurally rigid front panel having a bottom edge, a top edge and side edges extending therebetween with said front panel hingedly interconnected with said rear panel at one side edge thereof for selective swinging movement relative to that edge between a closed position disposed in superposed relationship to said rear panel and said header with the sample sheets interposed therebetween and an open position wherein said front panel is disposed to permit visual inspection of the samples, said front panel having a vertical extent substantially equal to the combined vertical extent of said rear panel and said header, and securing means adapted to selectively interconnect with said header and said front panel for maintaining said header in rigidly fixed relationship to said rear panel.

29. A carrier and storage binder for samples of sheet-form material disposed in stacked relationship comprising a structurally rigid rear panel having a bottom edge, a top edge and a side edge extending therebetween, a first header secured to said rear panel at the top edge thereof in upwardly projecting relationship, said first header adapted to receive fabric sample sheets in retained relationship with the samples extending therefrom in superposed relationship to said rear panel, a structurally rigid front panel having a bottom edge, a top edge and a side edge extending therebetween, a second header secured to said front panel at the top edge thereof in upwardly projecting relationship, said second header adapted to receive fabric sample sheets in retained relationship with the samples extending therefrom in superposed relationship to said front panel, hinge means interconnecting said rear and front panels along their respective side edges for enabling relative swinging movement of said panels and respective headers between a closed position with the panels and headers disposed in superposed relationship and an open position permitting visual inspection of the samples retained by each header, and securing means adapted to selectively interconnect with said headers when said headers and panels are in a closed position for maintaining each header in rigidly fixed relationship to its respective panel, said securing means including a first and second mechanically interengageable elements which are mounted on respective headers.

* * * * *